US005147228A

United States Patent [19]

Miller et al.

[11] Patent Number: 5,147,228

[45] Date of Patent: Sep. 15, 1992

[54] TERMINAL HAVING POSITIVE RETENTION FEATURE AND METHOD OF USING SAME

[75] Inventors: Mitchell E. Miller, Clemmons; Victor E. Slack, Lewisville, both of N.C.

[73] Assignee: AMP Incorporated, Harrisburg, Pa.

[21] Appl. No.: 859,277

[22] Filed: Mar. 26, 1992

Related U.S. Application Data

[63] Continuation of Ser. No. 698,516, May 10, 1991, abandoned.

[51] Int. Cl.[5] ..... H01R 13/415

[52] U.S. Cl. ..... 439/741

[58] Field of Search ..... 439/78, 79, 89, 741

[56] References Cited

U.S. PATENT DOCUMENTS

| | | | |
|---|---|---|---|
| 3,493,916 | 2/1970 | Hansen | 439/79 |
| 4,359,258 | 11/1982 | Palecek et al. | 339/176 MP |
| 4,410,230 | 10/1983 | San Miguel | 439/79 X |
| 4,550,962 | 11/1985 | Czeschka | 439/78 |
| 5,030,140 | 7/1991 | Sugiyama | 439/78 X |

FOREIGN PATENT DOCUMENTS

| | | | |
|---|---|---|---|
| 147749 | 4/1981 | German Democratic Rep. | 439/84 |

OTHER PUBLICATIONS

AMP Catalog 89-867, Issued Dec. 1989, pp. 1 and 7.

AMP Instruction Sheet IS3210, Released Mar. 12, 1990, pp. 1 and 3.

*Primary Examiner*—Eugene F. Desmond

*Attorney, Agent, or Firm*—David L. Smith

[57] ABSTRACT

A terminal (10) for an electrical connector (1). The terminal (10) comprises a mating portion (14) for mating with a contact of a mating connector, restraining means (58) for blocking withdrawal of the terminal (10) from the connector (1), and an elongate terminating portion (16) adapted to project from the connector (1). The terminating portion (16) comprises a leg (20) for terminating the terminal (10) to the substrate (4) and positive retention means (62) for securing the terminal (10) to the connector (1). The positive retention means (62) comprises a portion of the terminating portion (16) being adapted to be deflected at substantially a right angle.

12 Claims, 8 Drawing Sheets

TERMINAL HAVING POSITIVE RETENTION FEATURE AND METHOD OF USING SAME

This application is a continuation of application Ser. No. 07/698,516, filed May 10, 1991, now abandoned.

FIELD OF THE INVENTION

The invention to a terminal for an electrical power connector, and more particularly to a terminal having a positive retention feature.

BACKGROUND OF THE INVENTION

Terminals for use in a connector mounted on a substrate are generally secured to the substrate, typically by soldering, as well as the connector itself being secured to the substrate. This is done so that when a contact is disconnected from the terminal, the stress applied by unmating forces does not fracture the solder and pull the terminal from the substrate. By transferring a portion of such stress to the connector, a positive retention feature between the terminal and the connector reduces the amount of stress placed on the terminal solder.

Therefore, a terminal design which has positive retention features is desired, and preferably one which is foolproof in use and is relatively simple and inexpensive to manufacture and to install.

SUMMARY OF THE INVENTION

In accordance with the present invention, a terminal for an electrical connector is disclosed. The terminal comprises a mating portion for mating with a contact of a mating connector, restraining means for blocking withdrawal of the terminal from the connector, and an elongate terminating portion adapted to project from the connector. The terminating portion comprises a leg for terminating the terminal to the substrate and positive retention means for securing the terminal to the connector.

In accordance with the present invention, a method of securing in an electrical connector a terminal having an elongate terminating portion is disclosed. The method comprises the steps of: disposing the terminal in the connector with the terminating portion projecting therefrom and the terminal blocked from passing through the connector; and deflecting a portion of the terminating portion at substantially a right angle.

DETAILED DESCRIPTION OF THE PREFERRED EMBODIMENT

Figure 1:
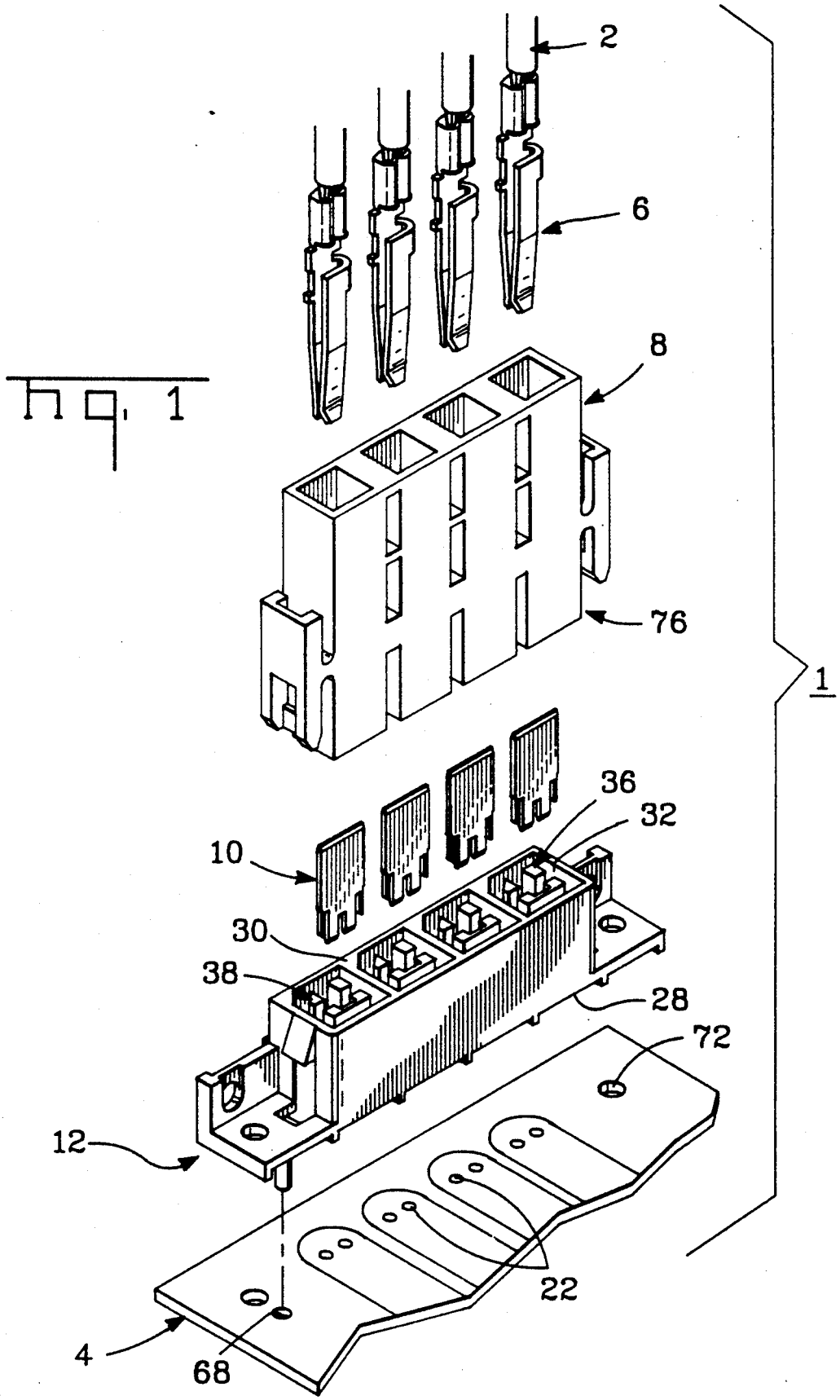
FIG. 1 is an exploded perspective view of the connector assembly of the present invention.

With more particular reference to the drawing, FIG. 1 shows an exploded view of a connector assembly 1 in accordance with the present invention. The connector assembly 1 electrically connects a wire 2 to a substrate 4, for example a printed circuit board. The connector assembly 1, shown with the wire 2 connected to a contact 6, comprises a housing 8, terminals 10, and a header 12. While the contact 6 may be of any type, it is preferred that the contact 6 be dual beam, and more particularly one similar to the receptacle contact part number 555485-1 shown on page 7 of AMP Catalog 89-867, INNERGY Power Distribution System for Modular Office Panels, issued December 1989, so as to mate with a plug style of terminal. (INNERGY is a trademark of AMP Incorporated.)

Figure 2:
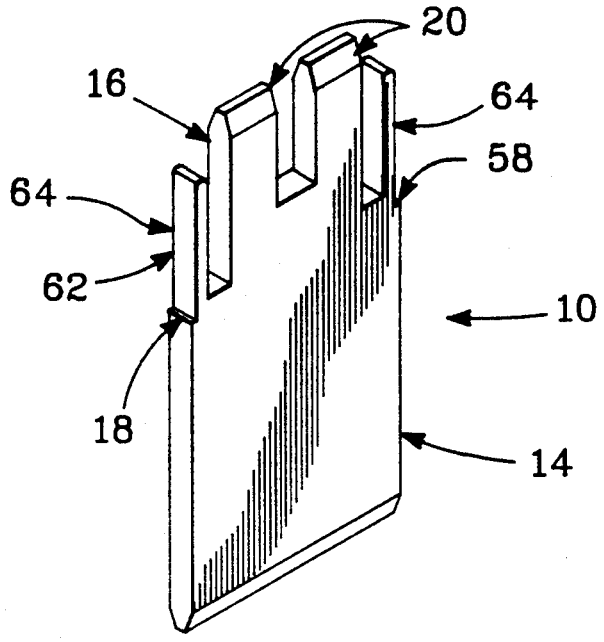
FIG. 2 is an enlarged perspective view of a terminal of the connector assembly shown in FIG. 1.
Figure 3:
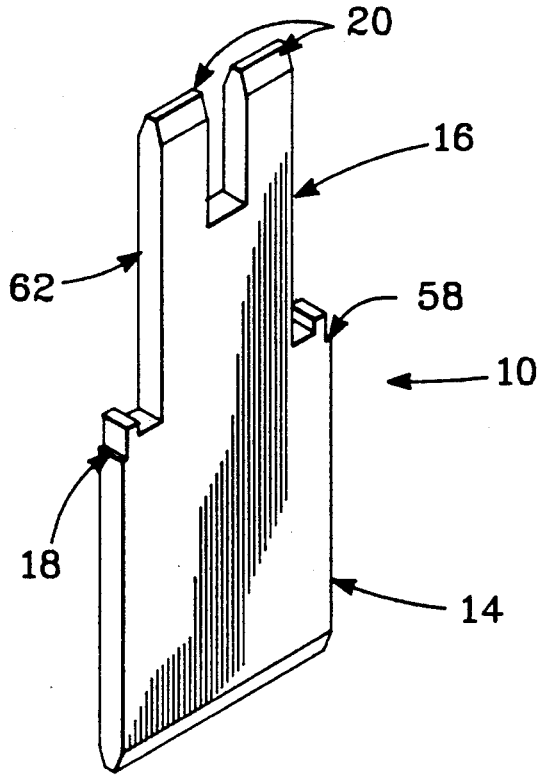
FIG. 3 is an enlarged perspective view of an alternate embodiment of a terminal of the connector assembly shown in FIG. 1 for right angle mounting.

The terminals 10 are stamped from flat stock, preferably copper alloy which is selectively plated with tin or silver. With reference to FIGS. 2 and 3, each terminal 10 comprises a mating portion 14 and an elongated terminating portion 16 projecting from an edge thereof. The mating portion 14 also includes shoulders 18 which assist in securing the terminal 10 in the header 12. The terminating portion 16 is for being terminated to the substrate 4, and ends with parallel legs 20, preferably two or more. Multiple legs 20 are used for more efficient heat dissipation and lower voltage drop to the substrate 4.

Figure 4:
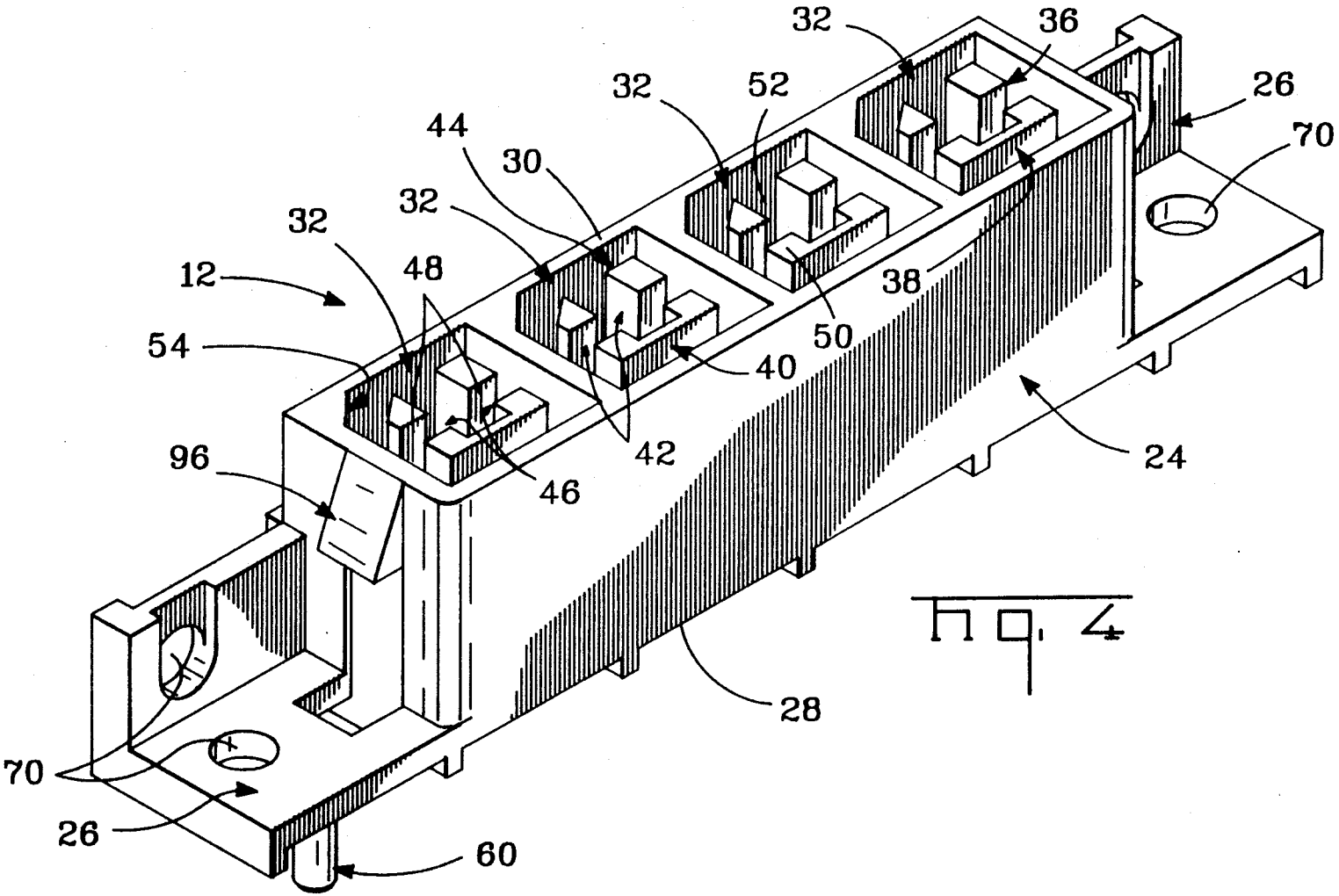
FIG. 4 is a top perspective view of a header of the connector assembly shown in FIG. 1.

The header 12 is made of a dielectric material, preferably polyphenylene sulfide (PPS), and is adapted for mounting on the substrate 4. With reference to FIGS. 1 and 4, the header 12 has a body 24, mounting ears 26 at opposite ends of the body 24, a mounting face 28, a mating face 30 opposite the mounting face 28, and, within the body 24, a plurality of terminal receiving cavities 32 each with a floor 34 at the mounting face 28 extending to the mating face 30.

Each terminal receiving cavity 32 has safety means 36 for protecting a technician from electrical shock by covering the terminal 10. The safety means 36 comprises a safety box 38 extending from the floor 34 at the mounting face 28 substantially the length of the cavity 32 to the mating face 30. The safety box 38 encircles the terminal 10 in order to keep probes, such as a finger or screwdriver, from contacting the terminal 10. The safety box 38 is a rhomboid quadrilateral, having a plain side 40, two opposed slotted sides 42, and a polarizing side 44.

The header 12 has aligning means 46 (See FIG. 4) for aligning the terminal 10 in the terminal receiving cavity 32 for mating with the contact 6. The two slotted sides 42 of the safety box 38, each have a slot 48 extending substantially the length of the side 42 from the floor 34 to the mating face 30. During insertion of the terminals 10 into the header 12, the slots 48 accept edges of the terminal 10 to align it in the header 12 at a predetermined position for mating with the contact 6.

The connector assembly 1 also has polarizing means 50 for polarizing or keying the mating of the header 12 with the housing 8. The polarizing means 50 comprises an opening 52 in the polarizing side 44 of the safety box 38 which cooperates with a portion of the housing 8 to provide keying to the connector assembly 1. Additionally, one corner of each terminal receiving cavity 32 is angled, forming a polarizing corner 54 to provide polarization with a respective portion of the housing 8.

Figure 5:
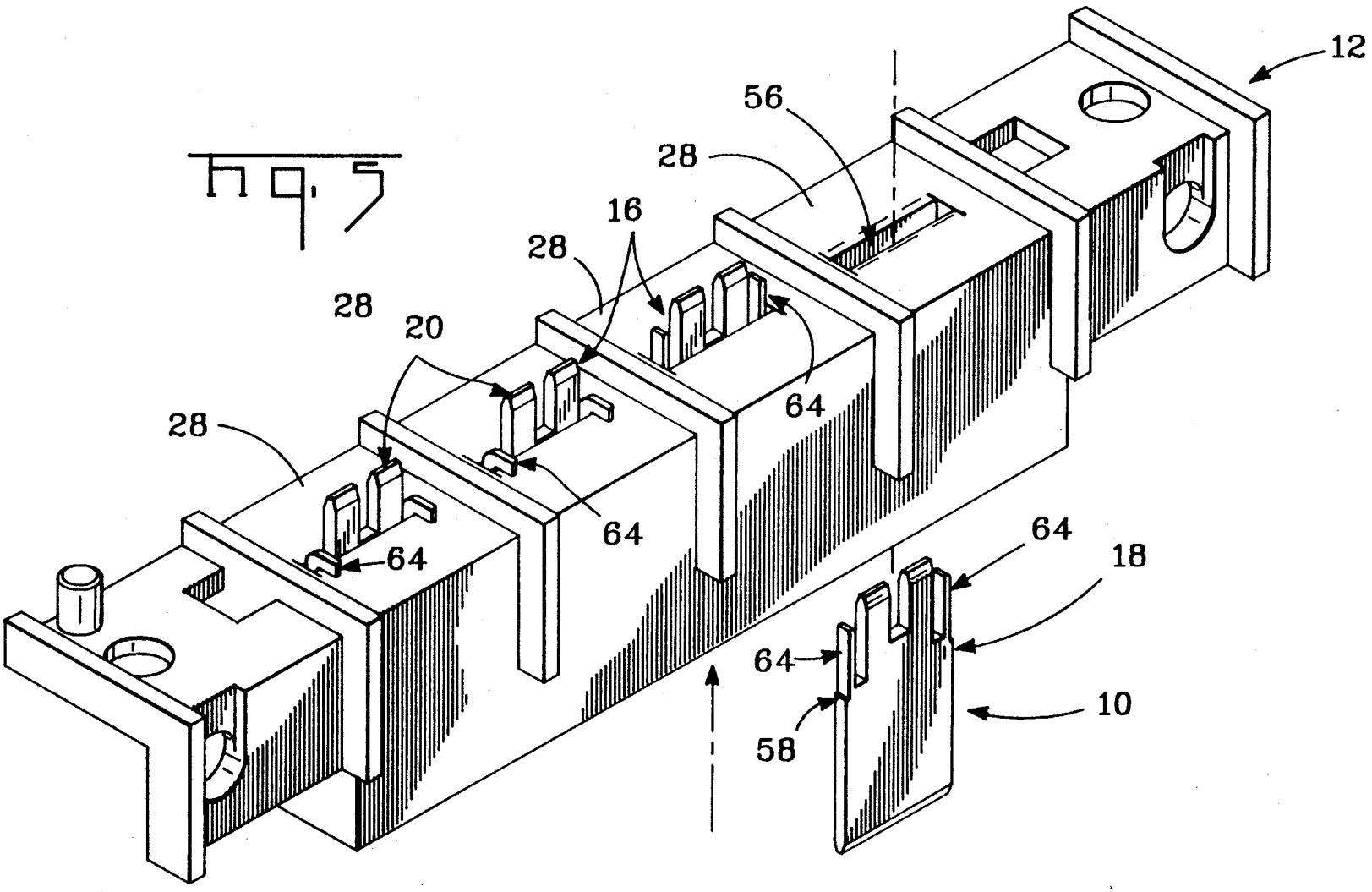
FIG. 5 is a bottom perspective view of the header of FIG. 4 with the contact of FIG. 2 installed for vertical mounting.
Figure 6:
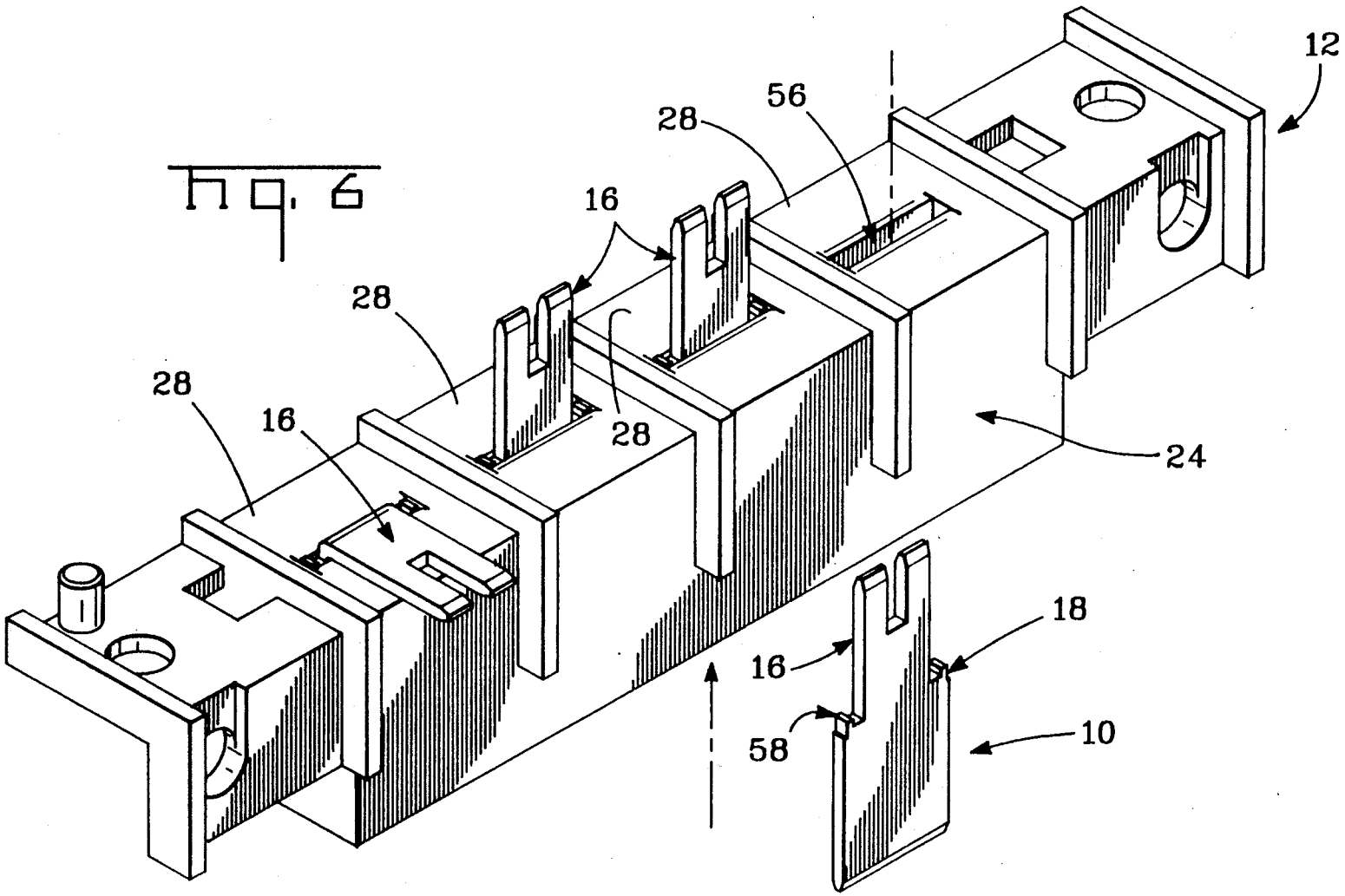
FIG. 6 is a bottom perspective view of the header of FIG. 4 with the contact of FIG. 3 installed for right angle mounting.

With reference now to FIGS. 5 and 6, each terminal receiving cavity 32 has a slit 56 in the floor 34 at the mounting face 28. The terminals 10 are assembled within the header 12 by being inserted from the terminal receiving cavity 32 terminating portion first through the slit 56 such that the terminating portion 16 extends out from the mounting face 28 of the header 12. The shoulders 18 of each terminal 10 provide restraining means 58 which articulate with the floor 34 of the terminal receiving cavity 32 to restrain the terminal 10 from passing through the header 12.

The mounting ears 26 of the header 12 are adapted for mounting the header 12 to the substrate 4 in either a vertical or right angle style. For a preferred embodiment of the vertical mount style, one mounting ear 26 includes a pin 60 for additionally aligning the header 12 on the substrate 4. The terminating portion 16 of the terminal 10 is adapted to provide positive retention means 62 for positively retaining the terminal 10 in the header 12.

For a vertical mount, an embodiment of the terminals 10 as shown in FIG. 2 is used. Each terminating portion 16 has two mounting tines 64, not for power transmission, but for securing the terminal 10 in the header 12. The two mounting tines 64 are bent at substantially a right angle against the mounting face 28, while the legs 20 remain straight for mounting to the substrate 4, as shown in FIG. 5. The terminating portion 16 need not be as elongated for the vertical mount style as for the right angle mount style, since the legs 20 extend directly to the substrate 4.

For a right angle mount, an embodiment of the terminals 10 as shown in FIG. 3 is used. The entire terminating portion 16 of each terminal 10 is bent at substantially a right angle against the mounting face 28, as shown in FIG. 6. The terminating portion 16 is elongated so that, when assembled, the legs 20 will extend beyond the body 24 of the header 12 for termination to the substrate 4.

The right angle mount style terminal 10 is stamped with tines 64 shorter than those for the vertical mount style. These tines 64 do not provide the positive retention feature, but are used principally for alignment of the terminal 10 within the header 12, although the tines 64 do assist the restraining means 58. If the tines 64 were to be deflected along with the rest of the terminating portion 16, the necessary deflection force would result in stresses so great that the terminal 10 and the header 12 would be damaged.

For both mounting styles, the bending of the terminating portion 16 opposes the shoulders 18 of the terminal 10 within the header 12 to secure the terminal 10 to the header 12. Bending of the terminating portion 16 or its mounting tines 64 is a relatively simple task which may be accomplished using a single hand tool, not shown.

The terminals 10 are terminated to the substrate 4 by inserting the legs 20 into various terminal receiving apertures 22 of the substrate 4. The terminals 10 may then be secured to the substrate 4 by any conventional method, such as by soldering. The header 12 may be secured to the substrate 4 by any means, such as a bolt 66 through an opening 70 in the mounting ear 26 and a mounting aperture 72 of the substrate 4. For a preferred embodiment of the vertical mount style, the pin 60 is inserted into a pin aperture 68 of the substrate 4 for additionally aligning the header 12 on the substrate 4.

Figure 7:
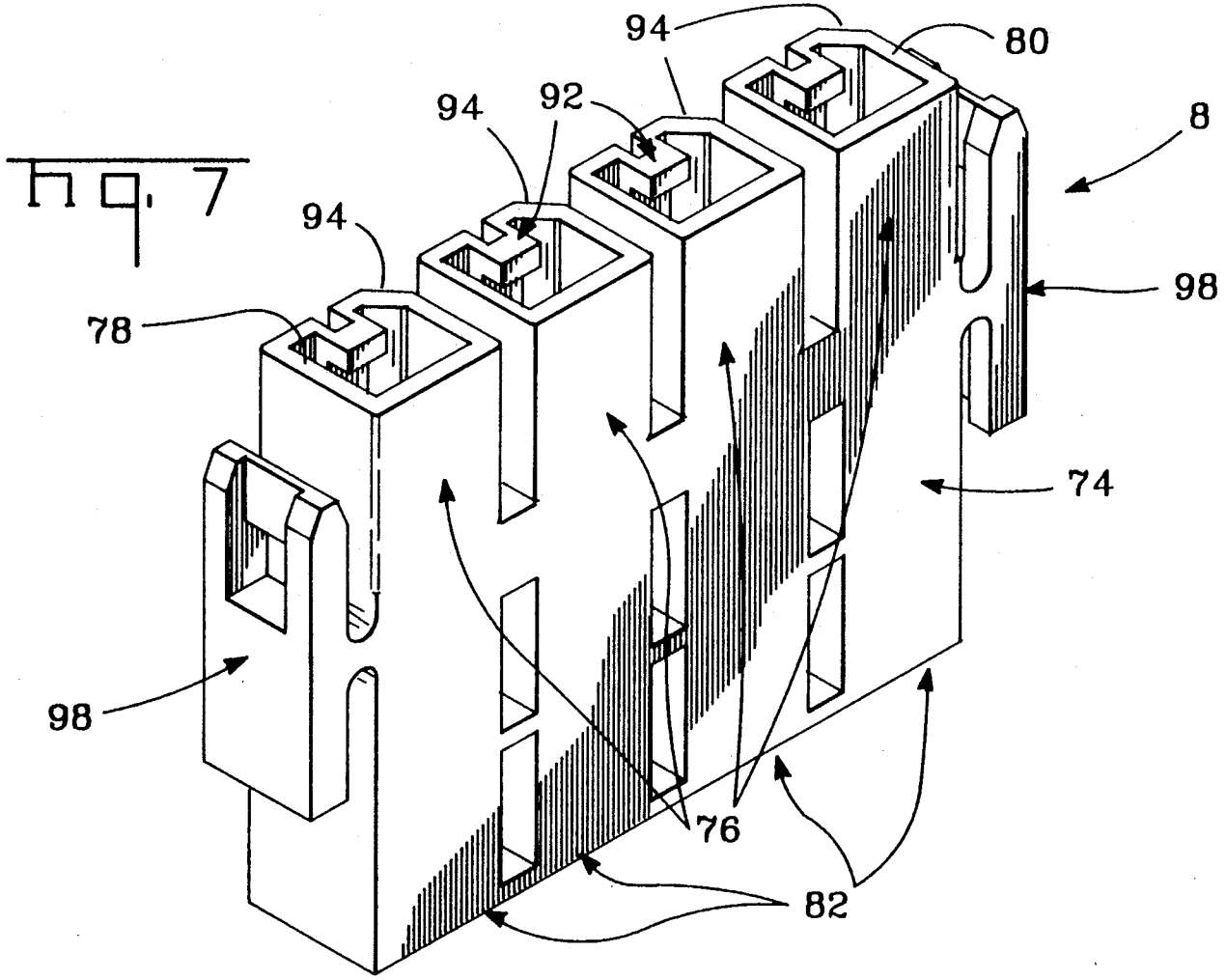
FIG. 7 is a bottom perspective view of a housing of the connector assembly shown in FIG. 1.

With reference now to FIG. 7, the housing 8 is made of a dielectric material, preferably a polycarbonate, and comprises a body 74 and a plurality of hollow plugs 76 projecting from the body 74. A front end 78 of each of the plugs 76 together define a mating face 80 of the housing 8. The body 74 includes a plurality of contact receiving cavities 82, each aligned with and corresponding to a respective plug 76. Each contact receiving cavity 82 is adapted to receive and secure one respective contact 6.

The contact 6 may be secured in place in the housing 8 by any means, such as that described on page 3 of Instruction Sheet IS-3210, Assembly and Installation of AMP INNERGY System Components, released Mar. 12, 1990. (INNERGY is a trademark of AMP Incorporated.) The contact receiving cavity 82 has rearward facing shoulders, not shown, cooperable with forward facing shoulders, not shown, of the contact 6 to block further insertion of the contact 6 into the contact receiving cavity 82. The contact receiving cavity 82 further has a forward facing latch, not shown, cooperable with a rearward shoulder, not shown, on the contact 6 to latch the contact 6 in place in the housing 8.

Each plug 76 is adapted to be received within the respective terminal receiving cavity 32 of header 12 and has an inner notch 92 for cooperation with the safety box 38 to provide additional polarization between the header 12 and the housing 8. Each plug 76 additionally has a polarizing bevel 94 which cooperates with the polarizing corner 54 of the respective terminal receiving cavity 32 of header 12 to provide additional polarization. Further, the notch 92 cooperates with the safety box 38 to provide additional electrical isolation to the terminal 10 and the contact 6.

Figure 8:
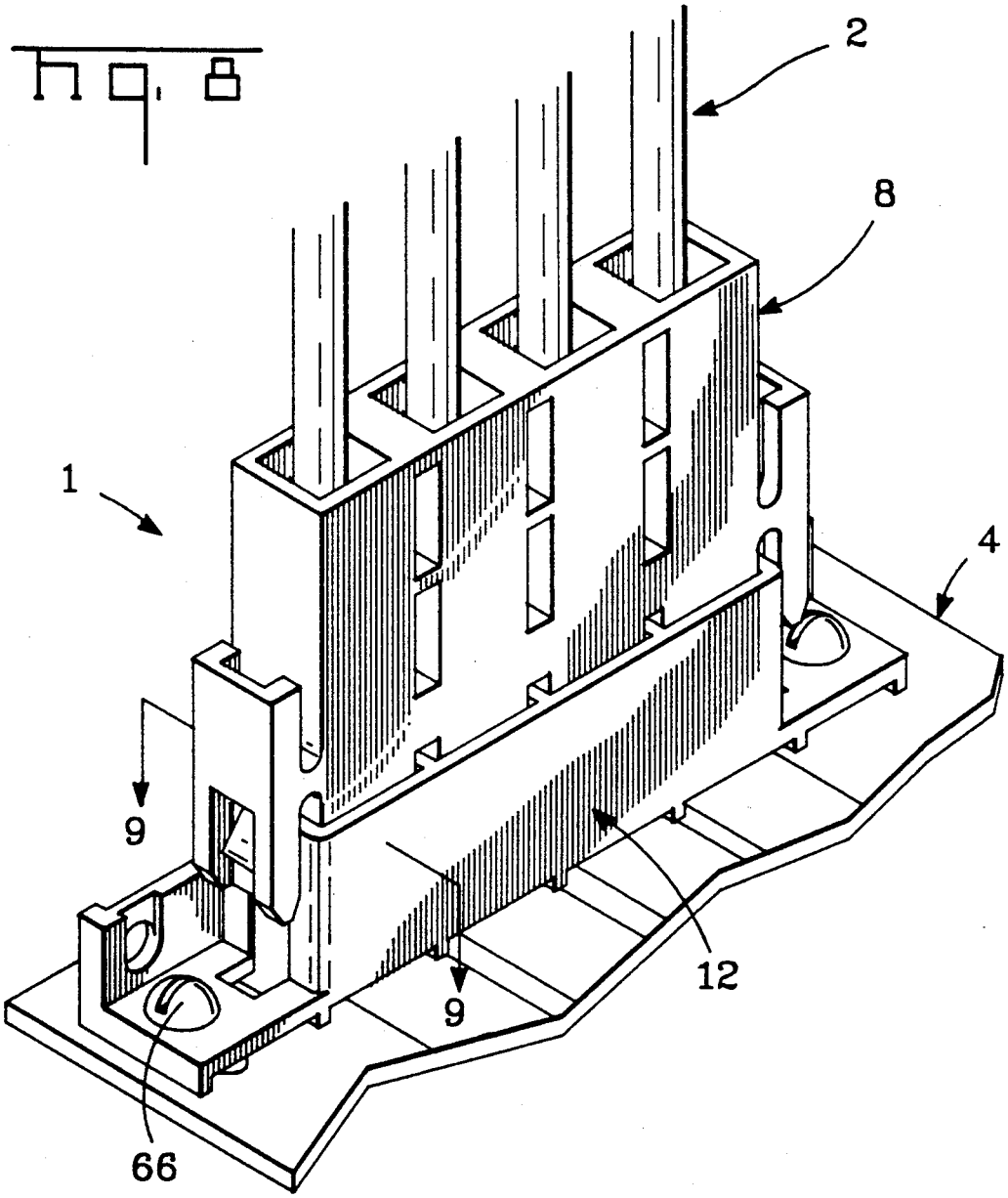
FIG. 8 is a perspective view of the connector assembly of FIG. 1 assembled and mounted on a substrate.

The assembly 1 is mated by the mating face 80 of the housing 8 being aligned with the mating face 30 of the header 12. The plugs 76 of the housing 8 are then inserted into the respective terminal receiving cavities 32 of the header 12. Each plug 76 surrounds the respective safety box 38 with its respective terminal 10 in place. The respective notch 92 fits within the polarizing side 44 of the safety box 38. The respective contact 6 is then within the safety box 38 and mates with the terminal 10. Additionally, latching means 96 of the header 12 cooperate with latching means 98 of the housing 8 to secure the housing 8 to the header 12. FIG. 8 shows the connector 1 assembled and mounted on the substrate 4.

Figure 9:
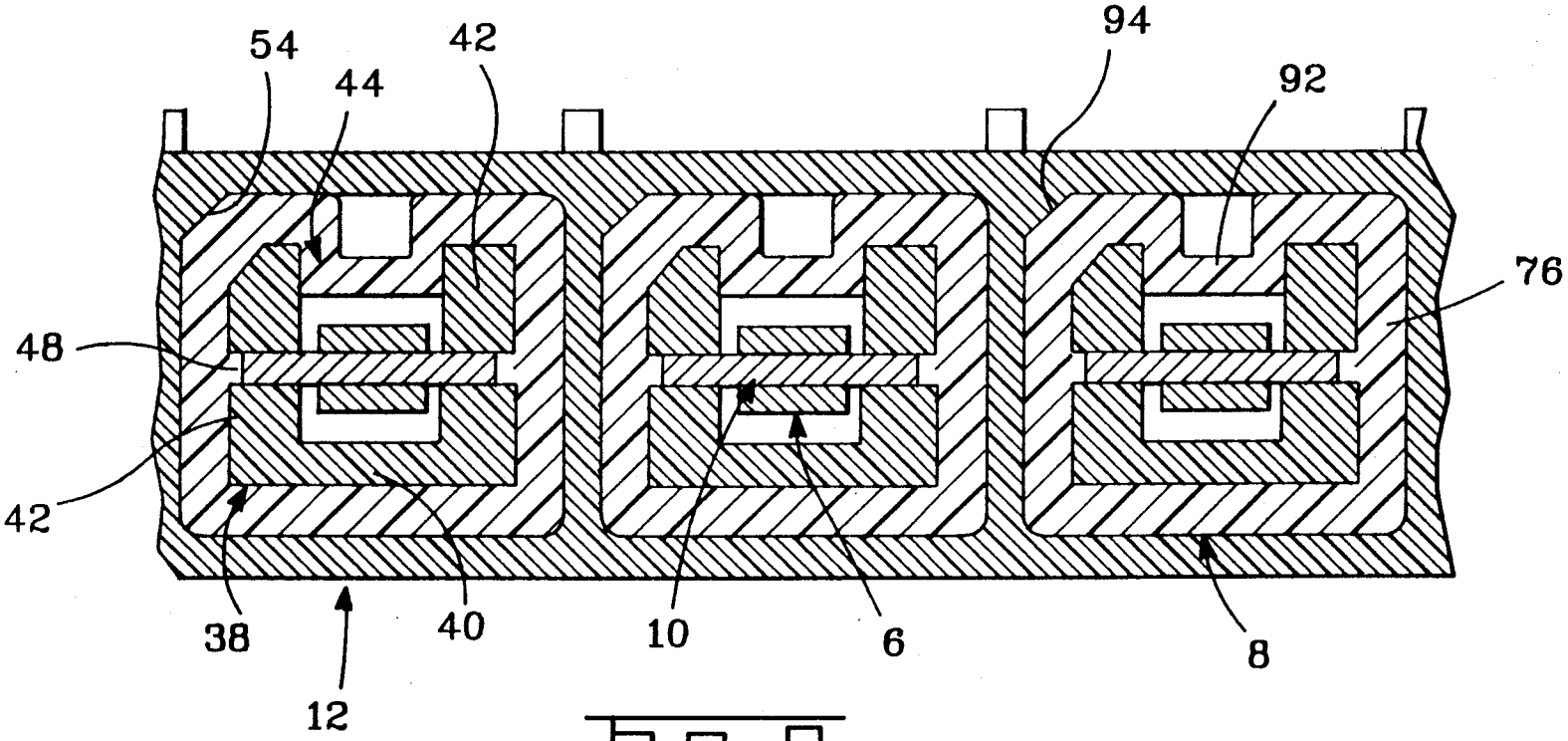
FIG. 9 is a sectional view of the connector assembly of FIG. 8 taken through line 9—9.

The mated terminal 10 and contact 6 are within three interlaid layers of dielectric material—the sides 40, 42, 42 of the safety box 38 and the notch 92 of the plug 76, the walls of the plug 76, and the walls of the terminal receiving cavity 32. The safety means 36, in cooperation with the housing 8 and the header 12, electrically isolates each pair of the terminal 10 and the contact 6. FIG. 9 shows the interlaying of the three layers of dielectric material.

Use of a terminal having the positive retention means 62 provides a relatively foolproof means of positively retaining the terminal 10 in a connector, which is simple and inexpensive to manufacture and to install.

What is claimed is:

1. An electrical terminal received in and secured to an electrical connector comprising:

an insulative header defining a mounting face, a mating portion of the terminal facing toward an open mating face of the header, a terminating portion of the terminal, tines laterally spaced from the terminating portion, the terminating portion being bent to overlie the mounting face of the header, and the tines remaining unbent for aligning the terminal in the header.

2. An electrical terminal in an electrical connector as recited in claim 1 wherein the terminating portion of the terminal further comprises: multiple legs at an end of the terminal for efficient heat dissipation.

3. An electrical terminal in an electrical connector as recited in claim 1, wherein, the terminal is bent to extend the terminating portion of the terminal toward a side of the mounting surface and beyond the header.

4. An electrical terminal in an electrical connector as recited in claim 1, wherein, the terminal includes restraining means for restraining the terminal from passing entirely through the header, and the terminating portion of the terminal is bent so as to oppose said restraining means to secure the terminal in the header.

5. An electrical terminal in an electrical connector as recited in claim 1, wherein, the terminating portion is laterally between restraining means for restraining the terminal from passing entirely through the header.

6. An electrical terminal in an electrical connector as recited in claim 5, wherein, the restraining means includes shoulders of the terminal on opposite sides of the terminal, the shoulders being articulated with a floor of the header.

7. An electrical terminal in an electrical connector comprising: an insulative header, a mating portion of the terminal facing toward an open mating face of the header, a terminating portion of the terminal between tines of the terminal having multiple legs to provide multiple electrical paths from the mating portion to a trace on a substrate on which the connector is mounted, the tines and the terminating portion extending from a mounting face of the header, the tines being bent to overlie the mounting face of the header, and the terminating portion without the tines being adapted for establishing an electrical connection.

8. An electrical terminal in an electrical connector as recited in claim 7, wherein, the terminal includes restraining means for restraining the terminal from passing entirely through the header, and the tines are bent so as to oppose the restraining means to secure the terminal in the header.

9. An electrical terminal in an electrical connector as recited in claim 7, wherein, the terminating portion is laterally between restraining means for restraining the terminal from passing entirely through the header.

10. An electrical terminal in an electrical connector as recited in claim 9, wherein, the restraining means includes shoulders of the terminal on opposite sides of the terminal, the shoulders being articulated with a floor of the header.

11. An electrical connector, comprising:

a dielectric housing having a bottom wall defining an inner surface and an outer surface, the bottom wall having at least one slot therethrough for receiving a terminal;

a terminal received in said at least one slot, said terminal having a mating portion extending away from said inner surface and a pair of spaced legs extending beyond the outer surface, said terminal having at least one shoulder engaging said inner surface to prevent the terminal from passing through the slot, said terminal having a pair of tines spaced outwardly from the legs, said tines extending through the slot to beyond the outer surface, the tines bent to overlie respective portions of the outer surface.

12. An electrical connector, comprising:

a dielectric housing having a bottom wall defining an inner surface and an outer surface, the bottom wall having at least one elongate aperture therethrough for receiving a terminal;

a terminal received in said at least one aperture, said terminal having a mating portion extending away from said inner surface and a terminating section extending beyond said outer surface, said terminal having at least one shoulder engaging said inner surface to prevent the terminal from passing through the aperture, said terminating section bent to be substantially normal to the mating portion and to extend along the outer surface, said terminating section terminating in a pair of spaced legs, said terminal having a pair of tines spaced outwardly from the terminating section, the tines received in the aperture and remaining unbent for aligning the terminal in the housing.

* * * * *